US012102154B1

(12) United States Patent
Khiyani

(10) Patent No.: US 12,102,154 B1
(45) Date of Patent: Oct. 1, 2024

(54) HEAT-REFLECTIVE SUBSTRUCTURE FOR A HAT

(71) Applicant: Salman Khiyani, Pembroke Pines, FL (US)

(72) Inventor: Salman Khiyani, Pembroke Pines, FL (US)

(73) Assignee: Salman Khiyani, Pembroke Pines, FL (US)

( * ) Notice: Subject to any disclaimer, the term of this patent is extended or adjusted under 35 U.S.C. 154(b) by 0 days.

(21) Appl. No.: 16/355,721

(22) Filed: Mar. 16, 2019

(51) Int. Cl.

| | |
|---|---|
| ***A42B 1/008*** | (2021.01) |
| ***A42B 1/02*** | (2006.01) |
| ***A42B 1/04*** | (2021.01) |
| ***A42B 1/241*** | (2021.01) |

(52) U.S. Cl.
CPC ..... *A42B 1/008* (2013.01); *A42B 1/02* (2013.01); *A42B 1/04* (2013.01); *A42B 1/241* (2013.01)

(58) Field of Classification Search
CPC .. A42B 1/008; A42B 1/02; A42B 1/04; A42B 1/241
See application file for complete search history.

(56) References Cited

U.S. PATENT DOCUMENTS 115,894 A * 6/1871 Prevot ..... A42B 1/008 2/7
270,155 A * 1/1883 Trested ..... A42B 1/02 2/200.1
770,031 A * 9/1904 Werrick ..... A42B 1/008 607/110
900,129 A * 10/1908 Stevens ..... A42B 1/002 2/175.4
1,056,018 A * 3/1913 Foster ..... A42B 1/002 2/175.4
1,236,984 A * 8/1917 Reis ..... A42B 1/002 2/175.4
1,303,796 A * 5/1919 Hinton ..... A42B 1/002 2/175.4
1,907,709 A * 5/1933 Barrow ..... A42B 1/008 2/209.3
2,007,821 A * 7/1935 Uriwal ..... A42B 1/02 D29/104
2,490,508 A * 12/1949 Delgatto ..... A42B 1/002 223/84

(Continued)

*Primary Examiner* — Bao-Thieu L Nguyen
(74) *Attorney, Agent, or Firm* — Nicholas E. Blanton, Esq.

(57) ABSTRACT

A light-weight heat-reflective substructure for a hat can be comprised of a semi-rigid bottom loop, top loop, two or more angled supports, and heat-reflective panels. The bottom loop can have a diameter commensurate with the size of the hat. The top loop can have a diameter commensurate with the diameter of the hat's crown. Each angled support can be coupled to the bottom and top loops, creating a three-dimensional frame. The angle that each angled support is coupled can be a minimum of fifteen degrees from a horizontal plane. The heat-reflective panels can couple to the angled supports of the frame, covering space between angled supports. The heat-reflective substructure can reduce an amount of thermal radiation transferred to the user by five percent or more as compared to wearing the hat without the heat-reflective substructure. Angling of the panels can increase an amount of surface area available for reflection.

18 Claims, 5 Drawing Sheets

Reflective Substructure with Covering 440

Side View

(56) References Cited

U.S. PATENT DOCUMENTS 3,131,401 A * 5/1964 Brown ..... A42B 1/04 2/175.1
3,766,565 A * 10/1973 Cozzens ..... A42C 5/04 2/200.1
4,912,778 A * 4/1990 Daniels ..... A42B 3/285 2/416
5,172,837 A * 12/1992 Finney, Jr. ..... A42B 1/002 223/66
5,548,846 A * 8/1996 Bianchetti ..... A42B 1/0184 2/209.12
5,556,013 A * 9/1996 Mayer ..... D06F 95/008 223/66
5,630,230 A * 5/1997 Fujino ..... A41D 20/005 2/200.1
5,669,075 A * 9/1997 Weeks ..... A42C 5/04 2/200.1
5,971,236 A * 10/1999 Des ..... D06F 95/008 223/66
6,182,295 B1 * 2/2001 Sciglia ..... G21F 3/02 2/200.1
6,234,368 B1 * 5/2001 DesForges ..... D06F 95/006 223/66
6,256,794 B1 * 7/2001 Erickson ..... A42C 5/00 2/171.03
6,343,382 B2 * 2/2002 Sciglia ..... A42B 1/008 2/200.1
7,076,810 B1 * 7/2006 Rossini ..... F41H 3/00 2/171.1
8,720,713 B2 * 5/2014 Olshansky ..... A61F 15/001 220/4.23
10,051,906 B1 * 8/2018 Kazmierczak ..... A42C 5/04
2001/0004770 A1 * 6/2001 Sciglia ..... G21F 3/02 2/200.1
2006/0248633 A1 * 11/2006 Marini ..... A42C 5/04 2/468
2007/0169873 A1 * 7/2007 Wang ..... B29C 66/1122 156/267
2007/0174949 A1 * 8/2007 Howells ..... A42B 1/008 2/171
2016/0007672 A1 * 1/2016 Ku ..... A42B 1/008 2/171.3
2016/0058084 A1 * 3/2016 Stevenson ..... A41D 20/005 2/209.13

* cited by examiner

HEAT-REFLECTIVE SUBSTRUCTURE FOR A HAT

BACKGROUND

The present invention relates to the field of hat, and more particularly to a heat-reflective substructure for a hat.

Hats are worn for a variety of reasons—as part of a uniform, as protection from the sun, as a fashion accessory, and so on. In many situations, wearing of a hat 115 by a person 110 increases the amount of heat 135 they feel, as shown in illustration 100 of FIG. 1 (PRIOR ART). Our environment often includes multiple sources 105 and 125 of thermal radiation 120 and 130. When outdoors, as in illustration 100, a person 110 is bombarded with thermal radiation 120 and 130 including ultraviolet (UV) 120 and infrared (IR) 130. Some materials used for hats 115 are capable of blocking the majority of UV radiation 120 from the sun 105. However, IR radiation 130 passes right through these materials to the person 110 wearing the hat 115, increasing how hot 135 they feel.

Environmental thermal radiation 120 and 130 is emitted from a source like the sun 105 or an oven or an object 125 like a car in a parking lot. Objects 125 absorb energy (UV radiation 120, visible light, IR radiation 130, etc.) from the available sources in their environment and then emit thermal radiation 130 into the environment at rates dependent on the emissivity of their different surfaces. For example, on a hot summer day, asphalt feels hotter to walk on than dirt due to asphalt having a higher emissivity than dirt (i.e., asphalt emits thermal radiation more than dirt).

What is needed is a hat 115 that reduces the amount of thermal radiation 120 and 130 felt by its wearer 110. Such a solution would be light-weight and not interfere with the shape or wear-ability of the hat.

BRIEF SUMMARY

One aspect of the present invention can include a heat-reflective substructure for a hat comprised of a light-weight, semi-rigid bottom loop, a light-weight, semi-rigid top loop, two or more light-weight, semi-rigid angled supports, and light-weight heat-reflective panels. The bottom loop can have a diameter that is commensurate with the size of the hat and can be of a height and thickness to provide structural support. The top loop can have a diameter that is less than the diameter of the upper portion of the hat. Each angled support can have a first end coupled to the bottom loop and a second end coupled to the top loop. Coupling of the angled supports to the top and bottom loops can create a three-dimensional frame that is able to be inserted into the hat without inhibiting wearing of the hat by a user. An angle at which each angled support is coupled can be within the bounds of the covering of the hat and can be a minimum of fifteen degrees from a horizontal plane defined by the bottom loop. Other angles having other degrees delta are contemplated so long as a sufficient angle is established to redirect heat/radiation such that significant cooling results. The heat-reflective panels can be of a size and shape for each space between adjacent angled supports in the frame. Each heat-reflective panel can couple to the angled supports of the frame that bound its respective space. Each heat-reflective panel can be installed at a substantially identical angle from the horizontal plane as its respective boundary angled supports. The heat-reflective substructure can reduce an amount of thermal radiation transferred to the user wearing the hat by five percent or more as compared to wearing the hat without the heat-reflective substructure, as thermal radiation that penetrates the hat is reflected away from the user. Angling of the heat-reflective panels can increase an amount of surface area available to reflect the thermal radiation.

Another aspect of the present invention can include a heat-reflecting hat that comprises a covering having a predefined size and shape for a specific type of hat and a light-weight heat-reflective substructure coupled to an interior of the covering. The covering can be made from a material that is acceptable for the specific type of hat. The heat-reflective substructure can include a semi-rigid bottom loop, a semi-rigid top loop, two or more angled supports, and light-weight heat-reflective panels. The bottom loop can have a diameter commensurate with the size of a head opening in the covering and can be of a height and thickness to provide structural support. The top loop can have a diameter that is less than the diameter of the upper portion of the covering. Each angled support can have a first end coupled to the bottom loop and a second end coupled to the top loop. Coupling of the angled supports to the top and bottom loops can create a three-dimensional frame that is able to be coupled to the covering without inhibiting wearing of the hat by a user. An angle at which each angled support is coupled can be within the bounds of the covering and a minimum of fifteen degrees from a horizontal plane defined by the bottom loop. The heat-reflective panels can be of a size and shape for each space between adjacent angled supports in the frame. Each heat-reflective panel can couple to the angled supports of the frame that bound its respective space. Each heat-reflective panel can be installed at a substantially identical angle from the horizontal plane as its respective boundary angled supports. The heat-reflective substructure can reduce an amount of thermal radiation transferred to the user wearing the hat by at least five percent as compared to wearing the hat without the heat-reflective substructure, as thermal radiation that penetrates the covering is reflected away from the user. Angling of the heat-reflective panels can increase an amount of surface area available to reflect the thermal radiation.

Yet another aspect of the present invention can include a heat-reflecting hat comprised of a covering having a predefined size and shape for a specific type of hat and a heat-reflective substructure coupled to an interior of the covering. The covering can be made from a material acceptable for the specific type of hat. The heat-reflective substructure can be comprised of a light-weight, semi-rigid three-dimensional frame and light-weight heat-reflective panels. The three-dimensional frame can be coupled to the covering without inhibiting wearing of the hat by a user and can include a bottom loop, a top loop, and two or more angled supports. The bottom loop can have a diameter commensurate with the size of a head opening in the covering and can be of a height and thickness to provide structural support. The top loop can have a diameter that is less than the diameter of the corresponding upper portion of the covering. Each angled support can have a first end coupled to the bottom loop and a second end coupled to the top loop. The angle at which each angled support is coupled can be within the bounds of the covering and a minimum of fifteen degrees from a horizontal plane defined by the bottom loop. The heat-reflective panels can be of a size and shape for each space between adjacent angled supports in the frame. Each heat-reflective panel can couple to the angled supports that bound its respective space. Each heat-reflective panel can be installed at a substantially identical angle from the horizontal plane as its respective boundary angled supports. The heat-reflective substructure can reduce an amount of thermal radiation transferred to the user wearing the hat by at least five percent as compared to wearing the hat without the heat-reflective substructure, as thermal radiation that penetrates the covering is reflected away from the user. Angling of the heat-reflective panels can increase an amount of surface area available to reflect the thermal radiation.

DETAILED DESCRIPTION

Figure 1:
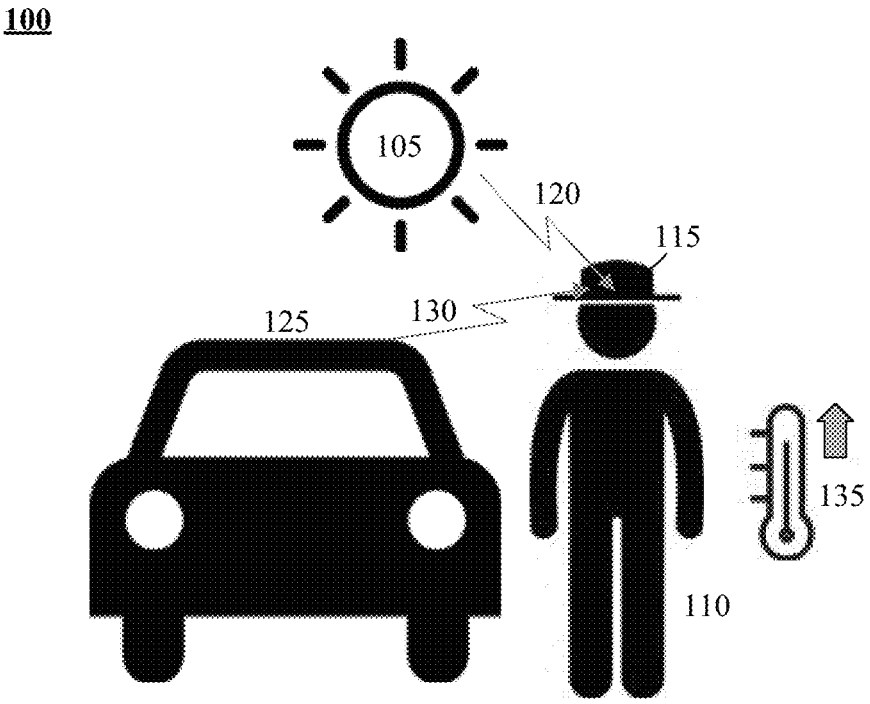
FIG. 1(PRIOR ART)
FIG. 1 (PRIOR ART) is an illustration of how thermal radiation penetrates conventional hats.
Figure 2:
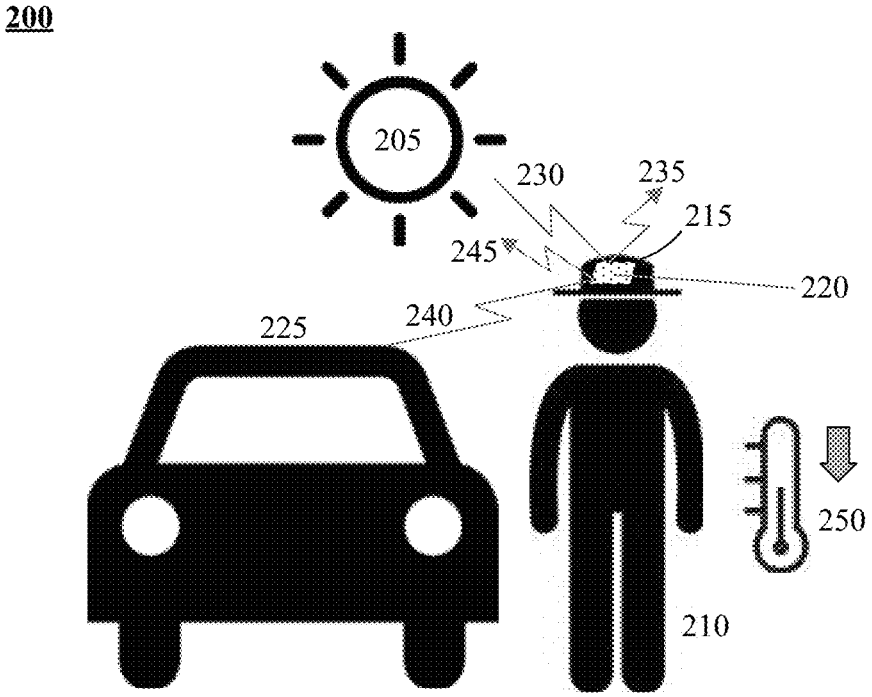
FIG. 2 presents an illustration depicting the effect of a heat-reflective substructure on environmental thermal radiation in accordance with embodiments of the inventive arrangements disclosed herein.

Embodiments of the disclosed invention can present a solution to cool the wearer of a hat by installing a heat-reflective substructure within the interior of the hat. The heat-reflective substructure can have a three-dimensional frame that is similar in size and shape to the size and shape of the hat covering. The sides of the frame can be angled so as to not be vertical. Heat-reflective panels can be coupled to the sides of the frame, which also angles the heat-reflective panels. The heat-reflective panels can reflect thermal radiation that penetrates the covering of the hat, preventing the wearer of the hat from experiencing the thermal radiation and its associated heat. The heat-reflective panels can utilize materials to specifically reflect infrared (IR) radiation FIG. 2 presents an illustration 200 depicting the effect of a heat-reflective substructure 220 on environmental thermal radiation 230 and 240 in accordance with embodiments of the inventive arrangements disclosed herein. Illustration 200 can utilize a similar environment as illustration 100 of FIG. 1 (PRIOR ART).

As such, the user 210 (wearer of the hat 215) can experience thermal radiation 230 and 240 from the sun 205 and a car 225 in the outdoors. Unlike in illustration 100, this user 210 can have a heat-reflective substructure 220 coupled to the interior of their hat 215. The heat-reflective substructure 220 can reflect 235 and 245 thermal radiation 230 and 240 that penetrates the hat 215, preventing the user 210 from experiencing the thermal radiation 230 and 240. Thus, the user 210 in illustration 200 can feel cooler 250 than the user 110 of illustration 100, despite both users 110 and 210 experiencing near-identical thermal radiation 120, 130, 230, and 240.

Figure 3:
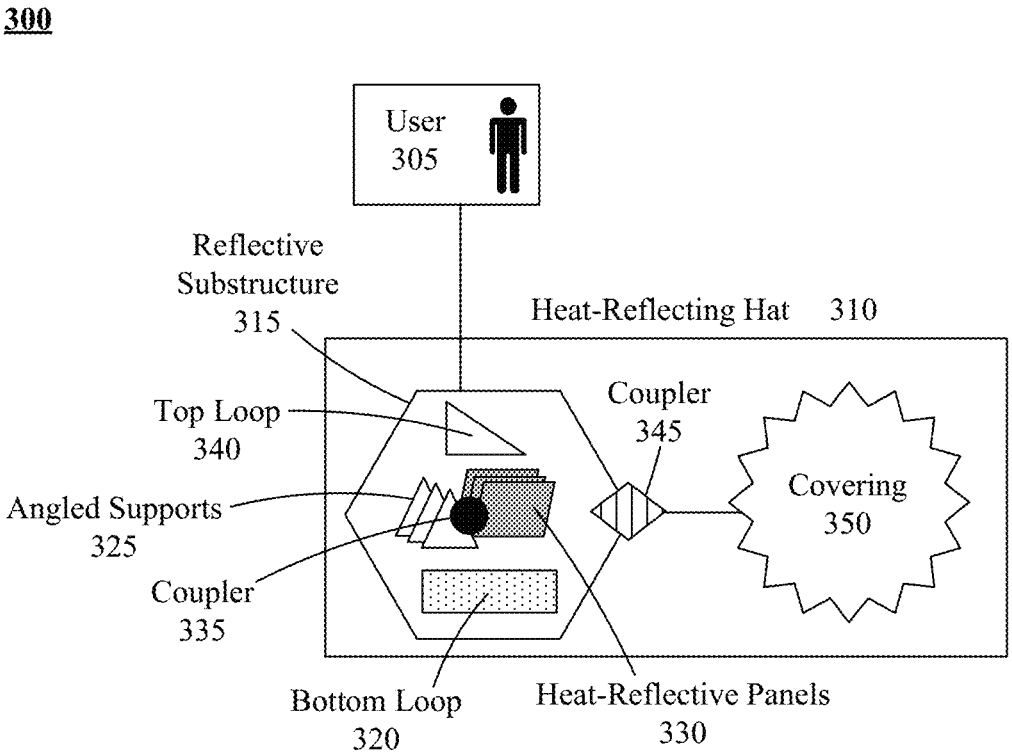
FIG. 3 is a block diagram of a system for a heat-reflecting hat that utilizes the heat-reflective substructure in accordance with embodiments of the inventive arrangements disclosed herein.

As shown in illustration 200, the incoming thermal radiation 230 and 240 can be reflected 235 and 245 away from the user 210 by the heat-reflective substructure 220. The reflected thermal radiation 235 and 245 can be essentially returned to the surrounding environment FIG. 3 is a block diagram of a system 300 for a heat-reflecting hat 310 that utilizes the heat-reflective substructure 315 in accordance with embodiments of the inventive arrangements disclosed herein. In system 300, a user 305, a person, can wear the heat-reflecting hat 310 to reduce the amount of thermal radiation that they experience.

The heat-reflecting hat 310 can be comprised of the heat-reflective substructure 315, herein referred to as the reflective substructure 315, coupled to a covering 350 via a coupler 345. As is well known in the Art, the covering 350 can represent the formed material that makes the hat 310 as well as any other details like feathers, ribbons, creases, dents, straps, bows, and etc. The specific type of hat 310 can dictate the type of material used for the covering 350 (i.e., a fez is traditionally made from felt and not plastic).

The reflective substructure 315 can be a light-weight, semi-rigid frame having heat-reflective panels 330. This frame can include a bottom loop 320, a top loop 340, and two or more angled supports 325 made from a material having a low thermal conductivity like many plastics, particularly if the frame will be in contact with the user's 305 head. The bottom loop 320 can be a circular component having a height and thickness to act as the structural support of the reflective substructure 315. The bottom loop 320 can have a diameter that is approximately the same as the opening in the covering 350 for the user's 305 head. The diameter of the bottom loop 320 can be significantly less than that of the opening; however, as the difference between the diameter of the bottom loop 320 and the opening increases, the coupler 345 can require additional elements and/or adjustment to accommodate the intervening space.

The top loop 340 can be a second circular component having a diameter that is within the bounds of the covering 350. Thus, the top loop 340 can be larger or smaller than the bottom loop 320. As the top loop 340 is being supported and not a support itself, it can be required to weigh less than the bottom loop 320, having less thickness and/or height.

It should be noted that while the reflective substructure 315 can be described herein in terms of circular components (i.e., bottom loop 320 and top loop 340) other planar geometric shapes are also contemplated like octagonal and hexagonal. The specific planar geometry used for the reflective substructure 315 can be dependent upon the cross-sectional geometry of the covering 350.

The angled supports 325 can couple to the bottom loop 320 and the top loop 340, creating the three-dimensional frame. Coupling of the angled supports 325 to the bottom and top loops 320 and 340 can be performed during or after manufacture using a variety of commensurate means. For example, the angled supports 325 and the bottom and top loops 320 and 340 can be manufactured as a single contiguous plastic structure via an injection molding process. Alternately, the components 320, 325, and 340 can be individually produced and glued together.

Each angled support 325 can be a linear element that is coupled to the bottom loop 320 at one end and the top loop 340 at its other end. The angled supports 325 can be of a thickness and width to support the top loop 340 at a predefined height above the bottom loop 320 while keeping their own structural integrity (i.e., remaining straight without bowing or sagging).

Each angled support 325 can be attached to the bottom and top loops 320 and 340 at an angle of at least fifteen degrees from the horizontal plane defined by the bottom loop 320, as will be illustrated in subsequent Figures. The angling of the angled supports 325 can be bounded by the shape/contour of the covering 350. That is, the angle of the angled supports 325 cannot be such that the reflective substructure 315 would disturb the silhouette of the heat-reflecting hat 310 by pressing against the covering 350.

Each angled support 325 can include one or more inherent couplers 335 for attachment of the heat-reflective panels 330 to the reflective substructure 315. The type of coupler 335 used can vary based upon the dimensions and/or materials used for the reflective substructure 315 and/or heat-reflective panels 330 for a specific implementation of the heat-reflecting hat 310. Examples of a coupler 335 can include, but is not limited to, an adhesive, a slide groove, a weld, a screw, a tie, a clip, a hook-and-loop fastener, a pin, a stitch, a staple, and the like.

The heat-reflective panels 330 can represent a relatively planar element that reflects thermal radiation. The heat-reflective panels 330 can utilize technology associated with a heat-reflective material, a heat-reflective foil, a heat-reflective laminate, a heat-reflective fabric, a heat-reflective composite, a combination of these technologies, a combination of these technologies with non-reflective elements, and the like. For example, a heat-reflective panel 330 can be comprised of a plastic element having a layer of aluminum foil attached to its exterior surface.

Examples of heat-reflective materials for use in the heat-reflective panels 330 can include, but is not limited to, a foil-laminated reflective fabric, a metallized thin film fabric laminate, a direct-metallized fabric, gold foil, aluminum foil, an aluminum reflective coating, an infrared reflective (IRR) or near infrared (NIR) coating, paint, or pigment, and other such materials available in the Art.

The heat-reflective panels 330 can be of sizes and shapes to cover the open spaces of in the frame created by the bottom loop 320, angled supports 325, and top loop 340. Each heat-reflective panel 330 can be attached to the couplers 335 of the angled supports 325 that bound the specific space in the frame. As such, each heat-reflective panel 330 can be installed within the reflective substructure 315 at substantially the same angle as its respective angled supports 325. Thus, if both angled supports 325 are coupled at a twenty-five degree angle, then the heat-reflective panel 330 coupled to those supports will also be at approximately a twenty-five degree angle.

Angling of the heat-reflective panels 330 can be beneficial for increasing the amount of surface area provided by the heat-reflective panel 330 to reflect thermal radiation. In another embodiment, the heat-reflective panels 330 can have a convex curvature to further increase surface area. In yet another contemplated embodiment, only the exterior surface (i.e., the surface facing the covering 350) can be convexly-rounded.

The reflective substructure 315 can be coupled to the covering 350 via one or more couplers 345 that are commensurate with the materials of the covering 350 and/or reflective substructure 315. The type of couplers 345 used should not damage the interior of the covering 350 nor distort its shape/contour. The couplers 345 can be permanent or reusable in nature. Reusable couplers 345 can be particularly beneficial for using the reflective substructure 315 with multiple and/or different coverings 350, allowing for various appropriately-sized coverings 350 to be converted into heat-reflecting hats 310.

Figure 4:
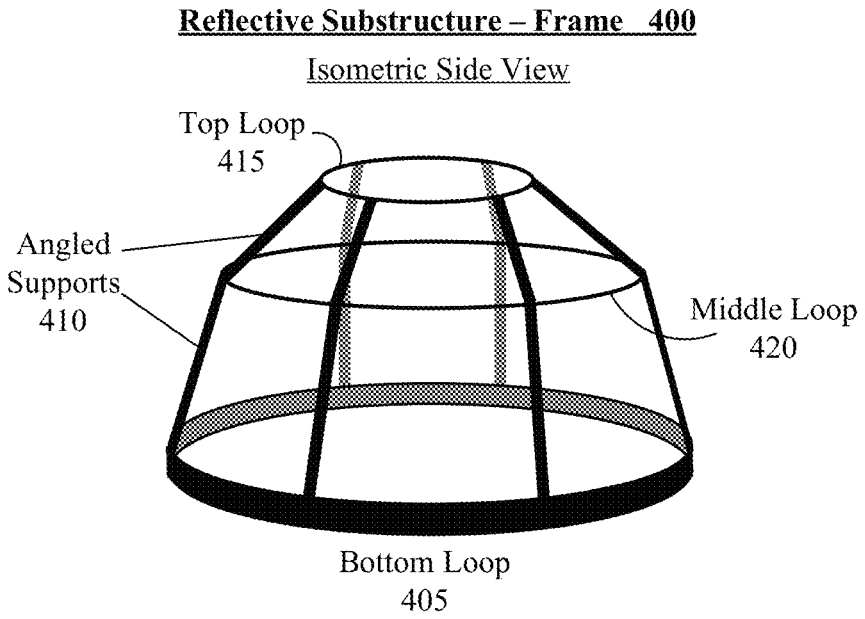
FIG. 4 presents illustrations depicting an example embodiment of the reflective substructure in accordance with embodiments of the inventive arrangements disclosed herein.
Figure 4:
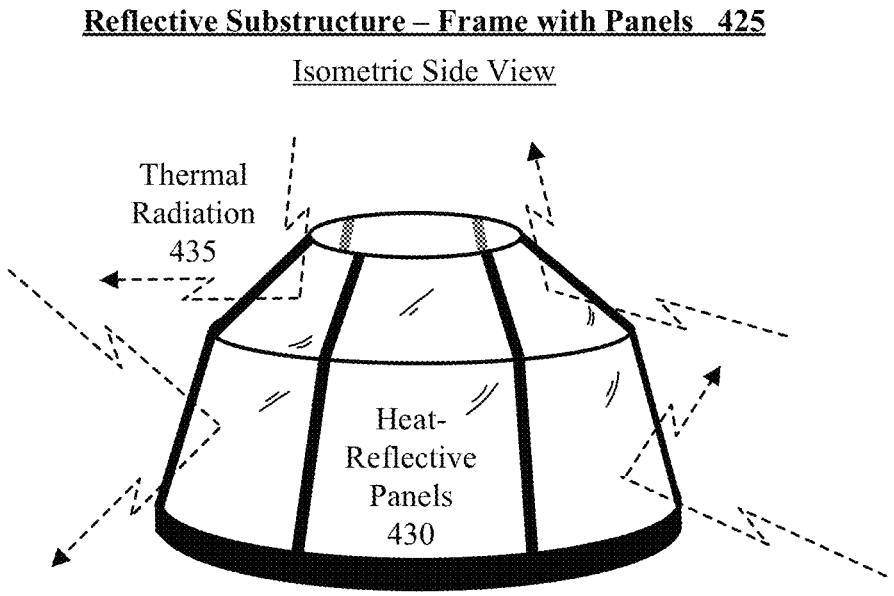

FIG. 4 presents illustrations 400 and 425 depicting an example embodiment of the reflective substructure in accordance with embodiments of the inventive arrangements disclosed herein. The embodiment presented in illustrations 400 and 425 can be utilized within the context of systems 200 and/or 300.

Illustration 400 can present an isometric side view of the reflective substructure's frame. As used herein, the term "frame" can be used to refer to the structural elements of the reflective substructure. In this particular embodiment, these structural elements can include the bottom loop 405, top loop 415, middle loop 420, and angled supports 410.

In this example embodiment, the difference in size and thickness between the bottom loop 405 and the middle and top loops 420 and 415 can be visually presented. The bottom loop 405 can have the largest diameter and thickness in order to provide support for other elements. The middle and top loops 420 and 415 can be smaller and thinner than the bottom loop 405, as they provide shape and not support for the frame.

Angled supports 410 can be coupled to the bottom loop 405 and the middle loop 420 and to the middle loop 420 and the top loop 415. The upper and lower angled supports 410 can be angled at the same or at different angles from horizontal. Further, the angled supports 410 can be distinct elements (i.e., two different sets of angled supports 410) or can be different segments of a single, jointed angled support 410. In the latter case, the middle loop 420 can act as a stabilizer that reinforces the joint between the segments.

As shown in illustration 400, the frame of the reflective substructure can have open spaces that are bound by angled supports 410 and two of the loops 405, 415, and 420. These open spaces can be where the heat-reflective panels 430 can be installed, as shown in illustration 425. Installation of the heat-reflective panels 430 can vary based upon the coupling mechanism employed by the specific implementation. For example, the heat-reflective panels 430 can be appropriately-sized and shaped pieces of heat-reflective fabric that are glued to the interior surface of the angled supports 410 and loops 405, 415, and 420.

Figure 4A:
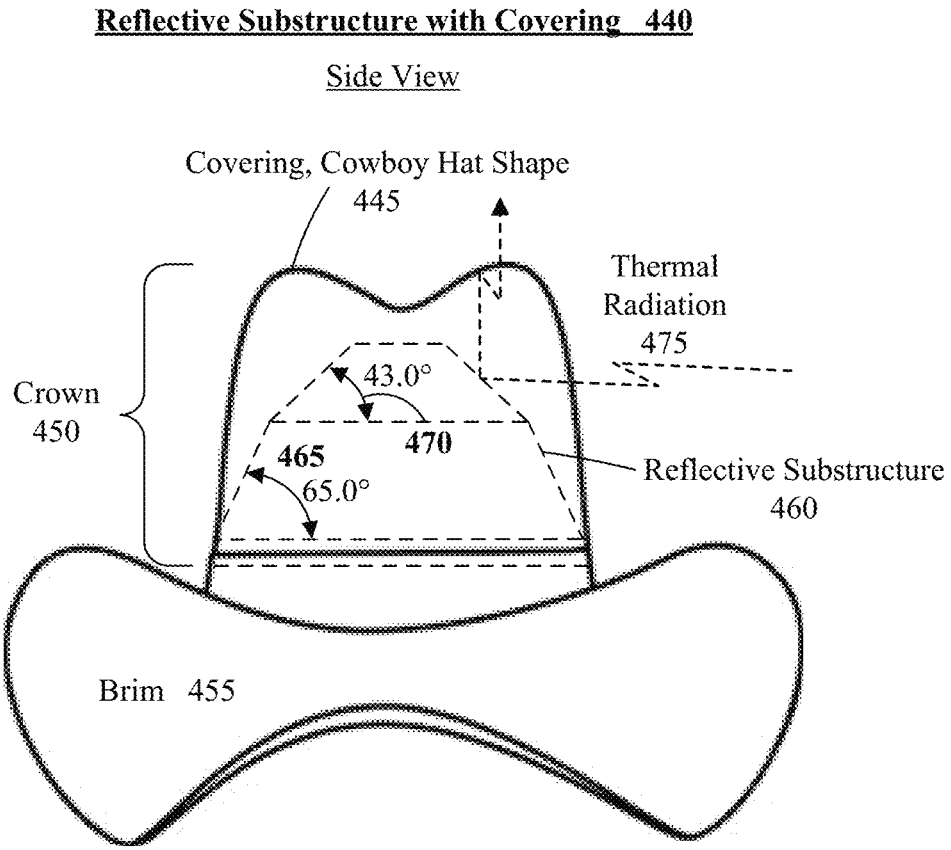
FIG. 4A is a side view illustration of the reflective substructure within a cowboy hat covering in accordance with embodiments of the inventive arrangements disclosed herein.

Each heat-reflective panel 430 can be coupled to the frame at an angle approximately identical to the angled supports 410 at its bounds. By angling the heat-reflective panels 430, the amount of surface area available to reflect thermal radiation 435 can be increased as opposed to a near-vertical or ninety-degree angle. This can be further exemplified in illustration 440 of FIG. 4A.

In illustration 440, the reflective substructure 460 can be shown coupled within a covering 445, as would be worn by a person. The covering 445 can be in the shape of a cowboy hat. As in known in the Art and as is common with most hats, an upper portion that accommodates the insertion of the wearer's head can be called the crown 450 and material that extends radially from the crown 450 can be the brim 455.

The reflective substructure 460 can be coupled to the covering 445 within the crown 450, in this example. The specific point within the covering 445 or crown 450 can vary by the type and/or size of the hat. It can be preferred that the reflective substructure 460 be coupled at such a point that it does not interfere with the wearing of the hat and/or does not contact the wearer's head, to prevent unintentional thermal transference to the wearer.

In illustration 440, the angles 465 and 470 of the angled supports and, therefore, the heat-reflective panels can be emphasized. In this example, the lower heat-reflective panels can be at an angle 465 of sixty-five degrees and the upper panels at an angle 470 of forty-three degrees. As each heat-reflective panel can be thought of as the hypotenuse of a right triangle, the heat-reflective panels can have a larger size, and, therefore, surface area, than a panel that is closer to ninety-degrees and the general contour of the crown 450. This can allow for the heat-reflective panels to reflect more its wearer.

Figure 5:
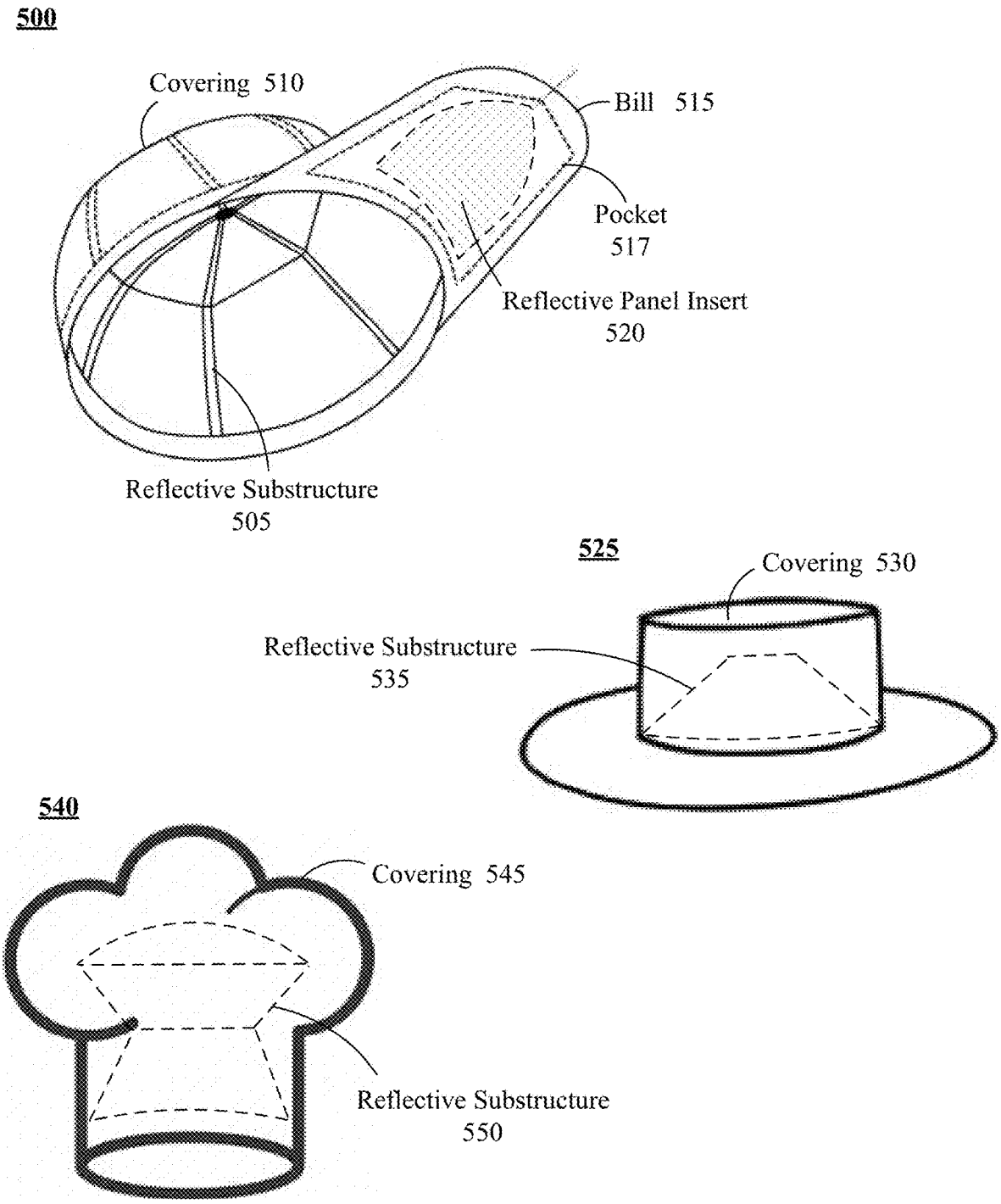
FIG. 5 is a collection of illustrations depicting contemplated embodiments for the reflective substructure for different hat coverings in accordance with embodiments of the inventive arrangements disclosed herein.

FIG. 5 is a collection of illustrations 500, 525, and 540 depicting contemplated embodiments for the reflective substructure 505, 535, and 550 for different hat coverings 510, 530, and 545 in accordance with embodiments of the inventive arrangements disclosed herein. The embodiments of the reflective substructure 505, 535, and 550 presented can be utilized within the context of systems 200 and/or 300.

Illustration 500 can show a covering 510 for a baseball cap with a bill 515 instead of a general brim. The reflective substructure 505 can be coupled to the interior of the covering 510. Additionally, the baseball cap can be manufactured with a pouch or pocket 517 in its bill 515 to hold a reflective panel insert 520. The reflective panel insert 520 can be a separate heat-reflective panel, with frame support if necessary, of a size and shape to fit into the corresponding pocket 517. The reflective panel insert 520 can be angled, though space restrictions can severely decrease the amount of angle that can be accommodated.

Once placed within the pocket 517, the reflective panel insert 520 can reflect thermal radiation that would normally pass through the bill 515 and to the wearer. Thus, a baseball player wearing a baseball cap with the reflective substructure 505 and the reflective panel insert 520 can feel cooler when standing on the field on a hot, sunny day.

Illustration 525 can present the reflective substructure 535 used within a typical straw hat covering 530. Unlike the reflective substructure 505 of illustration 500, the frame of the reflective substructure 535 can be comprised of only a top and bottom loop and angled supports, resulting in the frame resembling a truncated cone (i.e., a cone having its pointed tip removed). This configuration of the reflective substructure 535 can be desired for this type of hat covering 530 as the vertical height of the crown is relatively small.

Illustration 540 can show a toque covering 545 (i.e., a chef's hat) having a reflective substructure 550. Kitchens can be a workplace environment with a high level of thermal radiation. Thus, chefs and other staff can greatly benefit from having a heat-reflecting uniform hat.

The unique size and shape of the covering 545 can require an equally unique reflective substructure 550. Unlike previously presented reflective substructures, the upper heat-reflective panels of the reflective substructure 550 can be at an obtuse angle, creating an hourglass-shaped frame. These downward-facing heat-reflective panels can be beneficial in a kitchen environment as heat sources (e.g., ovens and stoves) are typically located lower than the person's hat 545. Thus, kitchen personnel can be more likely to encounter strong upward thermal radiation, which this configuration of the reflective substructure 550 would be capable of reflecting.

This example reflective substructure 550 can also include an additional heat-reflective panel covering the space of the top loop. This heat-reflective panel can be hemi-spherical or dome-shaped for additional coverage from downward thermal radiation. The angles needed for heat reflective properties are greater than those available in conventional art, and in some embodiments represent a minimum of ten or fifteen degrees from a horizontal plane, based on our research and testing. Angles, however can deviate as illustrated herein, for example, a series of angled planes having an overall radiation redirection effect can have individual angles of less than ten or fifteen percent, but an aggregate redirection effect (and an aggregate angle delta) sufficient to redirect heat. In embodiments, angles sufficient to reflect 10% of the radiation from directly striking a wearer's head (compared to a conventional hat of a similar style) or sufficient to reduce the heat transfer by 10% (compared to a conventional hat of similar style) are to be considered to fall within the scope of the disclosure. Although detailed as planes and angles in the disclosure, one of ordinary skill can understand that a series of curves designed for redirection and/or radiation reflection has the same effect as the elements described herein and is to be considered an "equivalent" or substantial equivalent of the details expressed herein. It should be appreciated that the hat detailed herein provides numerous radiation reflective angles expressly designed to achieve significant cooling by reflecting radiation away from the wearer, which is a cooling effect appreciable by a wearer.

The diagrams in the Figures illustrate the architecture, functionality, and operation of possible implementations of systems and methods according to various embodiments of the present invention. It will also be noted that each block of the block diagrams and combinations of blocks in the block diagrams can be implemented by special purpose hardware-based systems that perform the specified functions or acts, or combinations of special purpose hardware and computer instructions.

What is claimed is:

1. A heat-reflective substructure adapted for inserting into a hat comprising:

a light-weight, semi-rigid bottom loop having a diameter commensurate with a size of a head opening for a corresponding type of hat, wherein said bottom loop is of a height and thickness to provide a predefined amount of structural support;

a light-weight, semi-rigid top loop having a diameter that is less than the diameter of a corresponding upper portion of the hat;

at least two light-weight, semi-rigid angled supports, each angled support having a first end coupled to the bottom loop and a second end coupled to the top loop, wherein coupling of the at least two angled supports to the top and bottom loops creates a three-dimensional frame that is adapted to be inserted into the head opening without inhibiting wearing of the hat by a user, wherein each angled support is comprised of a first segment and a second segment, wherein the first segment is coupled to the bottom loop and the second segment is coupled to the first segment and the top loop, and the coupling of the first and second segments include coupling to a middle loop, wherein the first segment is coupled at a first angle of 65 degrees, and the second segment is coupled at a second angle of 43 degrees; and a light-weight heat-reflective panel of a size and shape for each space between adjacent angled supports in the frame, completing the heat-reflective substructure, wherein each heat-reflective panel couples to the angled supports of the frame that bound its respective space, wherein each heat-reflective panel is installed at a substantially identical angle from the horizontal plane as its respective boundary angled supports, wherein the heat-reflective substructure reduces an amount of thermal radiation transferred to the user wearing the hat by a percentage ranging from at least about one percent and up to about ten percent as compared to wearing the hat without the heat-reflective substructure, as thermal radiation that penetrates the hat is reflected away from the user.

2. The heat-reflective substructure of claim 1, wherein the heat-reflective panel utilizes at least one of a heat-reflective material, a heat-reflective foil, a heat-reflective laminate, a heat-reflective fabric, and a heat-reflective composite.

3. The heat-reflective substructure of claim 1, wherein an exterior surface of each heat-reflective panel is convexly-rounded.

4. The heat-reflective substructure of claim 1, wherein each heat-reflective panel is convexly-rounded.

5. The heat-reflective substructure of claim 1, wherein the frame is made from one of a heat-reflective material and a material having a low thermal conductivity.

6. The heat-reflective substructure of claim 1, wherein the frame is manufactured as a single element using a plastic material and an injection molding process.

7. The heat-reflective substructure of claim 1, wherein the hat conforms to the frame such that the hat is structurally supported thereby.

8. The heat-reflective substructure of claim 1, further comprising: a heat-reflective panel coupled to a top of the top loop.

9. A heat-reflecting hat comprising:

a covering having a predefined size and shape for a specific type of hat, wherein said covering is made from a material acceptable for the specific type of hat; and a light-weight heat-reflective substructure coupled to an interior of the covering, said light-weight heat-reflective substructure comprising:

a semi-rigid bottom loop having a diameter commensurate with a size of a head opening in the covering, wherein said bottom loop is of a height and thickness to provide a predefined amount of structural support;

a semi-rigid top loop having a diameter that is less than the diameter of a corresponding upper portion of the covering;

at least two semi-rigid angled supports, each angled support having a first end coupled to the bottom loop and a second end coupled to the top loop, wherein coupling of the at least two angled supports to the top and bottom loops creates a three-dimensional frame that is able to be coupled to the covering without inhibiting wearing of the hat by a user, wherein each angled support is comprised of a first segment and a second segment, wherein the first segment is coupled to the bottom loop and the second segment is coupled to the first segment and the top loop, and the coupling of the first and second segments include coupling to a middle loop, wherein the first segment is coupled at a first angle of 65 degrees and the second segment is coupled at a second angle of 43 degrees; and a light-weight heat-reflective panel of a size and shape for each space between adjacent angled supports in the frame, wherein each heat-reflective panel couples to the angled supports of the frame that bound its respective space, wherein each heat-reflective panel is installed at a substantially identical angle from the horizontal plane as its respective boundary angled supports, wherein the heat-reflective substructure reduces an amount of thermal radiation transferred to the user wearing the hat by a percentage ranging from at least about one percent and up to about ten percent as compared to wearing the hat without the light-weight heat-reflective substructure, as thermal radiation that penetrates the covering is reflected away from the user, wherein angling of the heat-reflective panels increases an amount of surface area available to reflect the thermal radiation.

10. The heat-reflecting hat of claim 9, wherein the heat-reflective panel utilizes at least one of a heat-reflective material, a heat-reflective foil, a heat-reflective laminate, a heat-reflective fabric, and a heat-reflective composite.

11. The heat-reflecting hat of claim 9, wherein, when the specific type of hat includes a bill or a brim having a predefined minimum thickness, said heat-reflecting hat further comprises:

a heat-reflective insert comprised of one or more heat-reflective panels attached to a light-weight frame, wherein said insert is of a size and a shape to be placed within a corresponding pocket or pouch within or attached to the bill or the brim, wherein a contour of the bill of the brim is undisturbed by placement of said heat-reflective insert.

12. The heat-reflecting hat of claim 9, wherein each heat-reflective panel convexly rounded.

13. The heat-reflecting hat of claim 9, wherein the frame of the heat-reflective substructure is made from one of a heat-reflective material and a material having a low thermal conductivity.

14. A heat-reflecting hat comprising:

a covering having a predefined size and shape for a specific type of hat, wherein said covering is made from a material acceptable for the specific type of hat; and a heat-reflective substructure coupled to an interior of the covering, said heat reflective substructure comprising:

a light-weight, semi-rigid three-dimensional frame that is able to be coupled to the covering without inhibiting wearing of the hat by a user comprising:

a semi-rigid bottom loop having a diameter commensurate with a size of a head opening in the covering, wherein said bottom loop is of a height and thickness to provide a predefined amount of structural support;

a semi-rigid top loop having a diameter that is less than the diameter of a corresponding upper portion of the covering;

at least two semi-rigid angled supports, each angled support having a first end coupled to the bottom loop and a second end coupled to the top loop, wherein each angled support is comprised of a first segment and a second segment, wherein the first segment is coupled to the bottom loop and the second segment is coupled to the first segment and the top loop, and the coupling of the first and second segments include coupling to a middle loop;

wherein the first segment is coupled at a first angle of 65 degrees and the second segment is coupled at a second angle of 43 degrees; and a light-weight heat-reflective panel of a size and shape for each space between adjacent angled supports in the frame, wherein each heat-reflective panel couples to the angled supports that bound its respective space, wherein each heat reflective panel is installed at a substantially identical angle from the horizontal plane as its respective boundary angled supports, wherein the heat-reflective substructure reduces an amount of thermal radiation transferred to the user wearing the hat by a percentage ranging from at least about one percent and up to about ten percent as compared to wearing the hat without the heat-reflective substructure, as thermal radiation that penetrates the covering is reflected away from the user, wherein angling of the heat-reflective panels increases an amount of surface area available to reflect the thermal radiation.

15. The heat-reflecting hat of claim 14, wherein the heat-reflective panel utilizes at least one of a heat-reflective material, a heat-reflective foil, a heat-reflective laminate, a heat-reflective fabric, and a heat-reflective composite.

16. The heat-reflecting hat of claim 14, wherein, when the specific type of hat includes a bill or a brim having a predefined minimum thickness, said heat-reflecting hat further comprises:

a heat-reflective insert comprised of one or more heat-reflective panels attached to a light-weight frame, wherein said insert is of a size and a shape to be placed within a corresponding pocket or pouch within or attached to the bill or the brim, wherein a contour of the bill of the brim is undisturbed by placement of said heat-reflective insert, wherein the one or more heat-reflective panels are angled at a minimum of ten degrees.

17. The heat-reflecting hat of claim 14, wherein each heat-reflective panel convexly rounded.

18. The heat-reflecting hat of claim 16, wherein a contour of the frame is similar to a contour of the hat.

* * * * *